United States Patent [19]

McCormick

[11] 4,394,946

[45] Jul. 26, 1983

[54] COLLAPSIBLE BOOTJACK

[75] Inventor: Robert C. McCormick, Grand Prairie, Tex.

[73] Assignee: HyJacker Products, Inc., Santa Maria, Calif.

[21] Appl. No.: 264,377

[22] Filed: May 18, 1981

[51] Int. Cl.[3] ..... A47J 51/02

[52] U.S. Cl. ..... 223/115

[58] Field of Search ..... D2/378.2; 223/114, 115, 223/113, 116, 117, 120; 297/439

[56] References Cited

U.S. PATENT DOCUMENTS

| | | | |
|---|---|---|---|
| 744,260 | 11/1903 | Thompson | 223/115 |
| 2,199,895 | 5/1940 | Sharp | 297/439 UX |
| 4,226,346 | 10/1980 | Turner | 223/115 |
| 4,262,828 | 4/1981 | Kosakai | 223/115 |

FOREIGN PATENT DOCUMENTS

| | | | |
|---|---|---|---|
| 61998 | 3/1944 | Denmark | 223/115 |
| 63700 | 7/1945 | Denmark | 223/115 |
| 257985 | 4/1949 | Switzerland | 223/115 |

*Primary Examiner*—Robert Mackey
*Attorney, Agent, or Firm*—Robert K. Rhea

[57] ABSTRACT

An elongated horizontal base is pivotally connected at one end with an upstanding link and has a stop forming tongue struck out of its link connected end portion in contact with the link. The link is connected at its upper end portion with a horizontally disposed U-shaped yoke for engagement with and removing a boot. The yoke and link may be pivoted to a common plane and pivoted as a unit to underlie the base when not in use.

3 Claims, 3 Drawing Figures

COLLAPSIBLE BOOTJACK

BACKGROUND OF THE INVENTION

The present invention relates to bootjacks and more particularly to a folding bootjack.

Well fitting cowboy boots are not easily removed and it is customary to use a bootjack comprising a length of board, or the like, having a V-shaped socket formed in one end thereof with the socket containing end of the board elevated by an underlying attached support for supporting the board on an incline. This permits the user to place one foot on the inclined board and place the quarter of the other boot in the socket for withdrawing his foot and leg. On account of their mass, these bootjacks are not easily transported for use as when traveling.

DESCRIPTION OF THE PRIOR ART

The most pertinitent prior patent is believed to be U.S. Pat. No. 4,226,346 which comprises a forward planar member having a V-shaped opening at one end and hingedly connected longitudinally at its rearward end with a rearward planar member for a folding superposed position of the forward and rearward members when not in use and which further includes a right angle leg member hingedly connected to the forward member and the hinge which depends from and supports the forward and rearward members when in extended position and inclined upwardly and forwardly.

This invention is distinctive over this patent by providing a boot quarter engaging yoke hingedly connected with the upwardly disposed end of a link pivotally connected at its depending end with one end of a planar base having an upwardly sprung tongue supporting the link against rearward overlying movement on the base. The link and yoke are pivotally folded to underlie the base when not in use.

SUMMARY OF THE INVENTION

An elongated planar base, adapted to overlie a supporting surface, is characterized by an elongated tongue struck out upwardly of one end portion intermediate its width to form a brace member and define legs at one end portion of the base. An elongated planar link, of substantially equal width with respect to the tongue, is pivotally connected at one end portion between the base legs. A generally U-shaped yoke has its legs pivotally connected adjacent its bight portion with the other end portion of the link disposing the yoke in a horizontal plane when in use. The yoke and link are pivoted to a common plane and in underlying relation with respect to the base when not in use.

The principal object of this invention is to provide a collapsible bootjack which may be easily erected for use and folded to lie in superposed planes underlying the base for ease of storage or transporting when not in use.

DESCRIPTION OF THE PREFERRED EMBODIMENT

Figure 1:
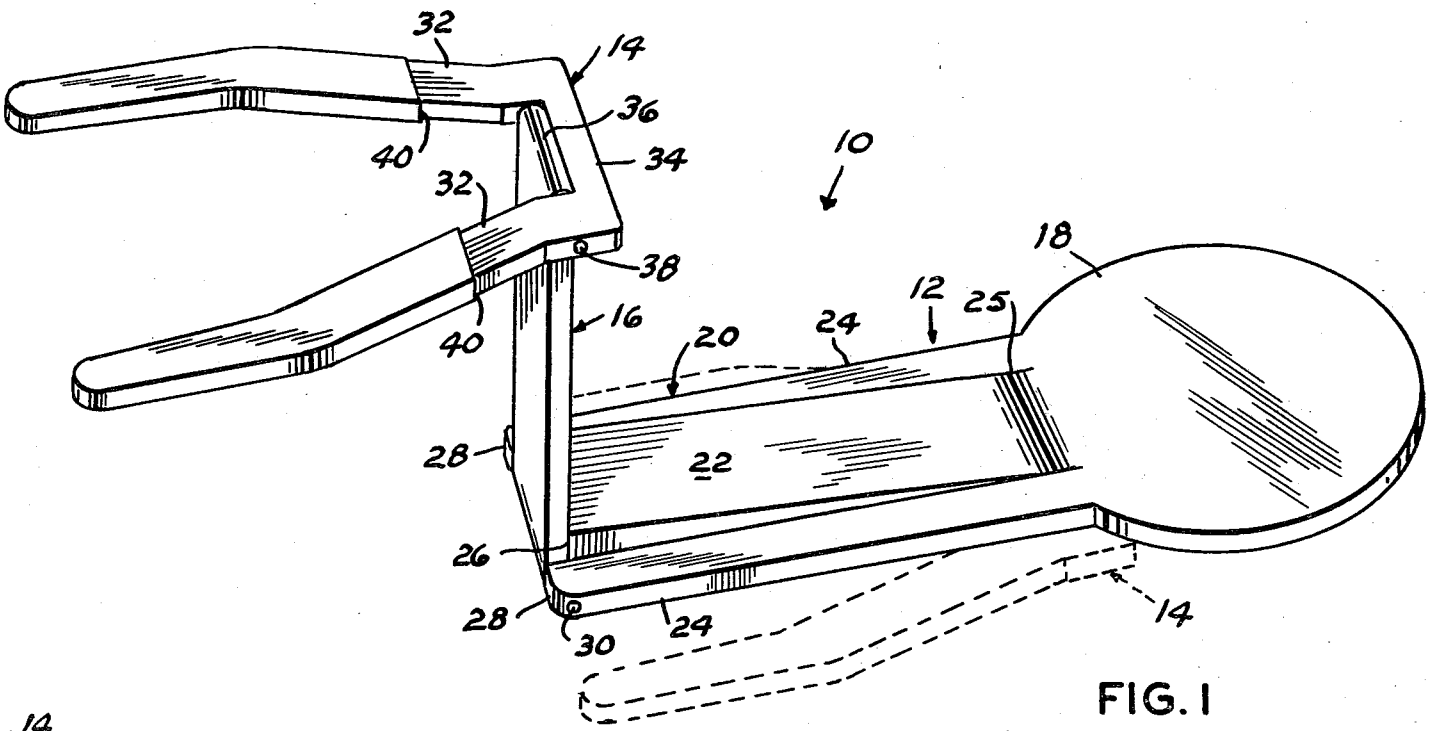
FIG. 1 is a perspective view of the bootjack in operative position and illustrating, by dotted lines, its folded position; and, FIG. 2 and 3 are perspective views, on a reduced scale, illustrating the movement of the yoke and link relative to the base when being pivoted from a folded and erected position.

Like characters of reference designate like parts in those figures of the drawing in which they occur.

In the drawings

The reference numeral 10 indicates the bootjack, as a whole, comprising a plurality of pivotally connected, preferably metallic, planar members including a base 12, a yoke 14 and a connecting link 16, foldable from an erected substantially Z-shaped configuration to a superposed planar position. The horizontally disposed base 12 is elongated rectangular in general configuration having a part-circular enlarged stabilizing portion 18 at its rearward end. The other or forward end portion 20 of the base is characterized by a coextensive rectangular tongue 22 centrally struck upwardly out of the end portion 20 forming a stop and defining opposing parallel base legs 24. The tongue 22 is turned arcuately upward adjacent its juncture with the part-circular portion 18, as at 25, to lie in an upward and forwardly inclined plane so that the depending surface at the free end 26 of the tongue is at least coincident with the plane of the upper surface of the base legs 24 to form a stop for the link 16, as presently explained.

The end 26 of the tongue is transversely severed or cut off a longitudinal distance at least equal to the thickness of the link 16 for the purposes presently explained.

The link 16 is elongated rectangular in general configuration having a thickness substantially equal with respect to the thickness of the base 12. One end portion of the link 16 is transversely disposed between the free end portions 28 of the base legs 24 and is connected thereto by a pin or pins 30, only one being shown, extending transversely through the base legs 24 and into or through the depending end of the link, as viewed in FIG. 1.

The yoke 14 is substantially U-shaped in general configuration having a thickness substantially equal with respect to the thickness of the base 12 and link 16 and characterized by a pair of legs 32 diverging from its bight portion 34. The spacing between the legs 32 is such that they frictionally engage opposing surfaces of a boot quarter, not shown, when disposed therebetween and the length of the bight portion 34 is such that the upwardly disposed end portion of the link 16 is closely received between the legs 32 adjacent their juncture with the bight portion 34. The upper end surface 36 of the link is arcuately curved for the purposes believed presently apparent.

The upper end portion of the link is connected with the yoke legs 32 by a pin or pins 38, only one being shown, extending transversely through the yoke legs 32 and into or through the link 16. The yoke legs 32 are preferably coated throughout the major portion of their length by a plastic material 40 to form a resilient surface to increase the coefficient of friction between the yoke legs and the quarter of a boot when disposed therebetween.

Operation

In operation, with the bootjack 10 in its solid line position of FIG. 1, the user places one foot upon the base 12 and disposes the quarter of his other boot between the yoke legs 32 to remove that boot from his foot in a substantially conventional manner. The yoke 14 resists the boot removing force tending to pivot the free end portions of the yoke legs in an upward and rearward direction by the transverse inner surface of the bight portion 34 contacting the rearward surface of the upper end portion of the link 16 in a yoke movement stop action. Similarly, rearward pivoting movement of the link 16 from its upstanding vertical position, normal to the plane of the base legs, resists the boot removing force by contact of the tongue end 26 with the rearward surface of the depending end portion of the link.

Figure 2:
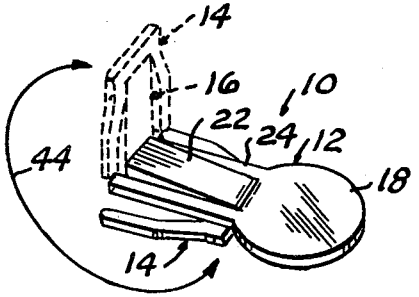
Figure 3:
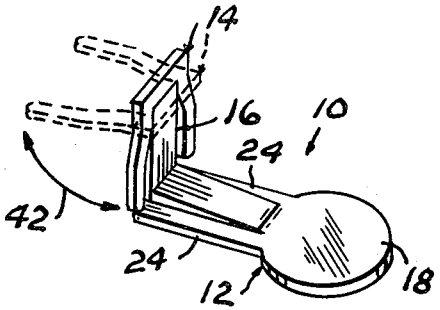

When not in use, the bootjack may be folded to its solid line position of FIG. 2, by pivoting the yoke 14, as shown by the directional arrow 42, from its dotted line position of FIG. 3 to lie in a plane common with the link 16 (FIGS. 2 and 3) and then the yoke and link pivoted as a unit, as shown by the directional arrow 44, to underlie the base 12.

Conversely, the bootjack may be erected from its folded solid line position of FIG. 2 by pivoting the yoke and link as a unit, as shown by the directional arrow 44 to its dotted line position and then pivoting the yoke 14 as shown by the directional arrow 42 to its dotted line position of FIG. 3 and as shown by solid lines in FIG. 1.

Obviously the invention is susceptible to changes or alterations without defeating its practicability. Therefore, I do not wish to be confined to the preferred embodiment shown in the drawings and described herein.

I claim:

1. A compact foldable bootjack, comprising:

an elongated horizontal base having a forward bifurcated end portion;

an elongated tongue struck out of said base adjacent its bifurcated end, said tongue having a transverse forward edge surface disposed above the upper surface of the base;

an elongated upstanding planar link pivotally connected at its depending end portion with the bifurcated end portion of said base and normally contacting said tongue edge surface for preventing rearward pivoting movement of said link; and, a normally horizontal yoke comprising a generally U-shaped planar member having a bight portion and forwardly projecting diverging legs adapted for frictionally engaging a boot quarter when disposed therebetween to facilitate removal of the boot from the user's foot, said yoke legs straddling the upper end portion of said link and pivotally connected therewith with said bight portion normally contacting the adjacent rearward surface of said link for preventing upward pivoting movement of the yoke legs, whereby said yoke legs may be pivoted downwardly to lie in the plane of said link and said yoke and said link may be pivoted forwardly and downwardly as a unit to underlie the plane of said base when not in use.

2. The bootjack according to claim 1 in which the rearward end portion of said base is transversely enlarged.

3. The bootjack according to claim 2 and further including:

a resilient coating surrounding said yoke legs for increasing the coefficient of friction with a boot quarter when disposed therebetween and preventing damage to the boot.

* * * * *